United States Patent [19]

Knowles

[11] Patent Number: 4,462,354

[45] Date of Patent: Jul. 31, 1984

[54] STARTING AIDS FOR INTERNAL COMBUSTION ENGINES

[75] Inventor: Richard P. Knowles, Farnborough, England

[73] Assignee: Lucas Industries Limited, Birmingham, England

[21] Appl. No.: 372,399

[22] Filed: Apr. 27, 1982

Related U.S. Application Data

[63] Continuation of Ser. No. 110,599, Jan. 9, 1980, abandoned.

[30] Foreign Application Priority Data

Feb. 1, 1979 [GB] United Kingdom ..... 7903600

[51] Int. Cl.[3] ..... F02B 3/02; F02M 31/00

[52] U.S. Cl. ..... 123/255; 123/254; 123/179 H; 219/205

[58] Field of Search ..... 123/254, 255, 179 H, 123/275, 261; 219/205, 270; 361/264

[56] References Cited

U.S. PATENT DOCUMENTS

| | | | |
|---|---|---|---|
| 2,112,787 | 3/1938 | Ricardo | 123/261 |
| 3,105,470 | 10/1963 | Hockel | 123/261 |
| 3,566,850 | 3/1971 | Beech | 123/145 |
| 4,340,019 | 7/1982 | Barnert et al. | 123/260 |

FOREIGN PATENT DOCUMENTS

| | | | |
|---|---|---|---|
| 4996108 | 9/1974 | China . | |
| 2324325 | 11/1973 | Fed. Rep. of Germany | 123/253 |
| 854483 | 4/1940 | France | 123/253 |
| 310954 | 3/1930 | United Kingdom | 123/275 |

*Primary Examiner*—Ronald H. Lazarus

[57] ABSTRACT

A starting aid for an internal combustion engine comprises a tubular extension in the end of which is wound an electric heating element. Surrounding the extension is a tubular member which ever at least a substantial portion of its length is mounted on spaced relationship to the extension. The member is formed from heat resistant material and acts to minimize the temperature attained by the extension when the aid is in use.

5 Claims, 5 Drawing Figures

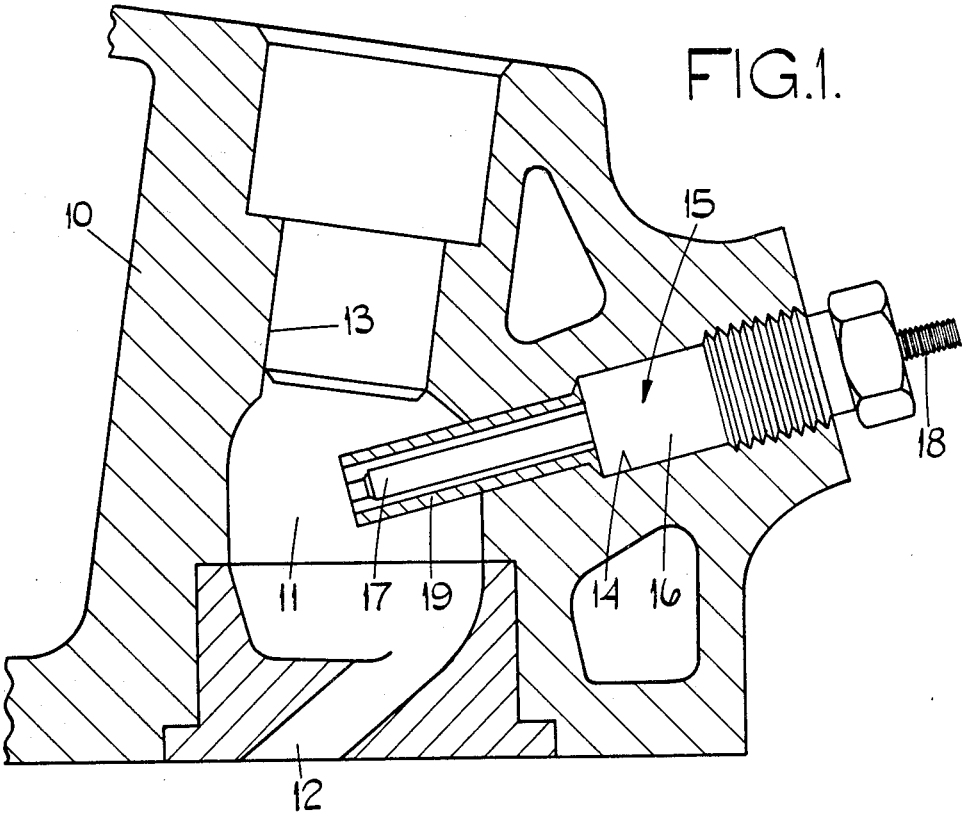
FIG.1.
FIG.2.
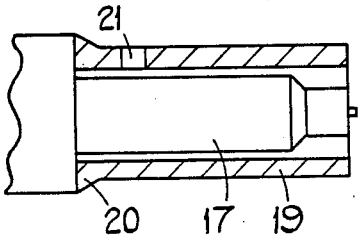
FIG.3.
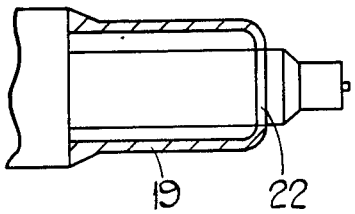
FIG.4.
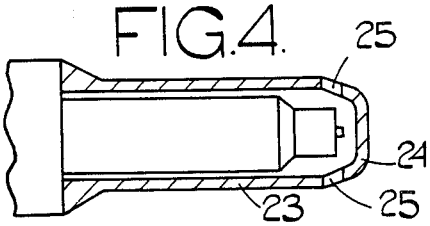
FIG.5.
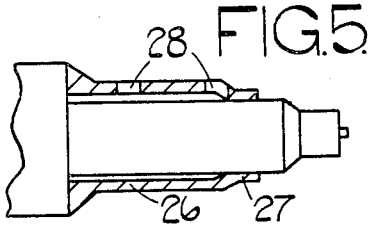

STARTING AIDS FOR INTERNAL COMBUSTION ENGINES

This is a continuation of application Ser. No. 110,599, filed Jan. 9, 1980, now abandoned.

This invention relates to starting aids for internal combustion engines of the kind comprising a body adapted to be retained in a bore formed in the cylinder head of the engine, a tubular extension located at one end of the body, part of said extension in use extending within a combustion chamber of the engine and a wound heating element located within the end of the tubular extension, said element in use, being heated by the passage of electric current to provide a heated surface within the combustion chamber.

An aid of this type is described in the specification of British Pat. No. 1127454. As described therein the heating element is formed from a metallic tape which is spirally wound about a central conductor rod to which the inner end of the element is connected. The outer end of the element is connected to the wall of the extension. The element is retained in position within the end of the extension by a glass sleeve which is located about the conductor rod and has its outer end adjacent the heating element, the glass sleeve being fused to the interior surface of the extension and to the rod.

It has been found that the service life of such a starting aid is considerably shortened in certain types of engines where the conditions within the combustion chamber are particularly severe. The portion of the extension located in the combustion chamber is subjected to the hot gases produced by combustion of fuel within the combustion chamber and a considerable amount of heat is absorbed by the extension of the point where mechanical failure of the aid occurs not necessarily whilst the heating element is being supplied with electric current. It has been found that the service life of the aid can be extended if in use, the temperature of the extension is reduced. If however, the thermal inertia of the heating element is materially increased then it will take longer to achieve its working temperature.

The object of the invention is to provide a starting aid of the kind specified in a simple and convenient form.

According to the invention a starting aid of the kind specified comprises an annular elongated member located about said extension, said member being formed from a material capable of withstanding the working conditions within the combustion chamber, at least a substantial portion of the inner surface of the member being disposed in spaced relationship to the surface of the extension.

According to a further feature of the invention the end of the member adjacent the body is extended to define a flanged portion which in use, is trapped between the body and a step defined in the wall of the bore in which the aid is located.

In the accompanying drawings:

FIG. 1 is a sectional elevation through the cylinder head of a compression ignition engine showing a starting aid mounted on the engine and, FIGS. 2, 3, 4 and 5 show part sectional side elevations of parts of starting aids in accordance with the invention.

Referring to FIG. 1 of the drawings, a cylinder head 10 of an engine defines a pre-combustion chamber 11 which communicates with the associated cylinder by way of a passage 12. The cylinder head is provided with a pair of bores 13, 14 each of which is of stepped form. The bore 13 in use, accommodates a fuel injection nozzle through which liquid fuel is supplied under pressure to the pre-combustion chamber 11.

The bore 14 locates a starting aid 15 which comprises a body portion 16 having screw threads for engagement with complementary threads formed in the wider portion of the bore 14. The body of the starting aid extends beyond the end of the bore 14 and is of hexagonal form to facilitate the tightening of the aid within the bore.

Extending through the narrower portion of the bore 14 into the combustion space is a cylindrical extension 17 which at its end within the combustion chamber has an end portion of reduced diameter formed by a reduced wall thickness. The extension is of tubular form and located within the end portion is a spirally wound electric heating element formed from a metal tape. The outer end of the tape is secured to the extension 17 whilst the inner end is secured to a support rod extending within the extension and connected with a terminal 18 which in use, is connected to a source of electric supply through a switch. The other terminal of the source of supply is connected to the engine and the arrangement is such that when the switch is closed the aforesaid heating element will heat quickly to its operating temperature to facilitate the starting of the engine. The rapid heating is obtained because the thermal inertia of the hearing element is low.

In use, during the compression stroke of the associated engine air is forced into the pre-combustion chamber 11 through the passage 12. The temperature of the air within the combustion chamber rises as compression of the air takes place, and fuel sprayed into the combustion chamber is ignited under normal circumstances, by the fact that the temperature within the combustion chamber is sufficient to cause ignition. The combustion gases escape through the passage 12 to act upon the piston within the cylinder. For starting purposes the heating element is supplied with electric current and the hot surface of the element assists the initiation of combustion since when the engine is cold, the temperature of the compressed air within the combustion chamber at the end of the compression stroke may be insufficient to promote rapid ignition of the injected fuel.

The end portion of the extension 17 within the combustion chamber is subjected to considerable heat from the burning gases and in addition the main part of the extension due to the turbulence of the gases, is also subject to considerable vibration. Its wall thickness is therefore chosen to withstand the stress in the region adjacent the body 16. The end portion is of reduced wall thickness to reduce the thermal inertia of the heating element.

It has been discovered that if the temperature of the extension is reduced, the service life of the aid is considerably extended. The problem however, is that if the thermal inertia of the heating element is materially increased, then it will take longer to achieve its operating temperature.

In order to reduce the temperature attained by the extension and as shown in FIGS. 1 and 2 a tubular member 19 is located about the extension. In this example the whole of the interior surface of the member 19 is spaced from the surface of the extension 17. The end of th member 19 adjacent the body 16 of the aid is provided with an outwardly extending flange 20 which in use, is trapped between the body 16 and the stop in the wall of the bore 14. Conveniently, the presented faces of the step and the flange 20 are inclined to the axis of the member, it being understood that a gas seal is established therebetween to prevent escape of gases from the combustion chamber. Moreover, the length of the member is substantially the same as the length of the portion of the extension which projects from the body 16.

The member 19 extends the full length of the extension and as shown in FIG. 2 an aperture 21 or a plurality of such apertures is provided in the wall of the member adjacent the body of the aid. The purpose of the aperture is to facilitate the flow of gas through the annular space defined between the member and the extension as the pressure within the chamber varies.

The member is formed from a material capable of resisting the conditions within the combustion chamber conveniently a high temperature alloy. The member acts as a heat shield to protect the extension from the extremes of heat within the combustion chamber. The member 19 shown in FIGS. 1 and 2 is not secured to the body or extension. The member 19 shown in FIG. 3 is retained relative to the extension 17 by rolling the end of the member into a groove 22 formed in the main portion of the extension. In this case however, the prime purpose of so retaining the member and extension is to prevent them becoming separated during transit.

In the aid shown in FIG. 4 the member 23 has an integral and closure 24 which extends in spaced relationship around the reduced end portion of the extension. Apertures 25 are provided to allow the air/fuel mixture within the combustion chamber to have access to the heating element and also to allow gas flow in the annular space between the member and the extension. The end closure 24 shields the heating element from the hammering effects of the combustion process in the combustion chamber.

In the arrangement shown in FIG. 5 the member 26 has a portion 27 at its end remote from the body 16 which is of reduced diameter and which is an interference fit on the main portion of the extension. Axially spaced apertures 28 are again provided to allow gas to flow in the space defined between the member and the extension. In this arrangement the member acts as a shield and it also acts to conduct heat away from the portion of the extension which is engaged by the portion 27 of the member. In addition it also acts to protect the extension and the heating element from vibration induced by the process of combustion within the combustion chamber by altering the natural frequency of the extension.

It has been found that there is a significant reduction in the temperature attained by the extension by the use of the heat shield as described. With the exception of the arrangement shown in FIG. 4 tests have shown that there is no significant increase in the time required for the heating element to attain its working temperature. It has also been found that the types of shield shown in FIGS. 2, 3 and 4 acts to provide some protection against vibration created by the combustion process.

I claim:

1. An internal combustion engine including means defining a combustion chamber, a first bore opening into the combustion chamber to accommodate a fuel injection nozzle, a second bore opening into the combustion chamber, said second bore having an outer screw threaded portion, an intermediate plane portion and an inner plane portion, the inner portion having a smaller diameter than the intermediate portion, an electric starting aid located within said second bore, said starting aid having a body which extends within the intermediate and outer portions of the bore, said body having an outer screw threaded portion the threads of which engage the threads of the outer portion of the bore, a tubular extension mounted on said body, said tubular extension extending through the inner portion of the bore into the combustion chamber, a wound heating element located within the end of the tubular extension remote from the body, said element in use, being heated by the passage of electric current to provide a heated surface in the combustion chamber to assist the ignition of fuel therein, an annular elongated member located about said extension, said member being formed from a material capable of withstanding the working conditions within the combustion chamber, at least a substantial portion of the inner surface of the member being disposed in spaced relationship to the surface of said extension, and an aperture in the wall of said elongated member, said elongated member at its end adjacent the body defining a flanged portion which is trapped between the body and a step defined at the junction of the intermediate and narrower portions of the bore.

2. An engine according to claim 1, in which said aperture is positioned adjacent the body of the aid.

3. An engine according to claim 1, in which the end portion of the elongated member remote from the body is of reduced diameter to provide an interference fit with the external surface of the extension.

4. An internal combustion engine including means defining a combustion chamber, a first bore opening into the combustion chamber to accommodate a fuel injection nozzle, a second bore opening into the combustion chamber, said second bore having an outer screw threaded portion, an intermediate plane portion and an inner plane portion, the inner portion having a smaller diameter than the intermediate portion, an electric starting aid located within said second bore, said starting aid having a body which extends within the intermediate and outer portions of the bore, said body having an outer screw threaded portion the threads of which engage the threads of the outer portion of the bore, a tubular extension mounted on said body, said tubular extension extending through the inner portion of the bore into the combustion chamber, a wound heating element located within the end of the tubular extension remote from the body, said element in use, being heated by the passage of electric current to provide a heated surface in the combustion chamber to assist the ignition of fuel therein, an annular elongated member located about said extension, said member being formed from a material capable of withstanding the working conditions within the combustion chamber, at least a substantial portion of the inner surface of the member being disposed in spaced relationship to the surface of said extension, an aperture in the wall of said elongated member, and a groove formed in the exterior surface of the extension, the end portion of the member remote from the body being deformed into said groove.

5. An internal combustion engine including means defining a combustion chamber, a first bore opening into the combustion chamber to accommodate a fuel injection nozzle, a second bore opening into the combustion chamber, said second bore having an outer screw threaded portion, an intermediate plane portion and an inner plane portion, the inner portion having a smaller diameter than the intermediate portion, an electric starting aid located within said second bore, said starting aid having a body which extends within the intermediate and outer portions of the bore, said body having an outer screw threaded portion the threads of which engage the threads of the outer portion of the boree, a tubular extension mounted on said body, said tubular extension extending through the inner portion of the bore into the combustion chamber, a wound heating element located within the end of the tubular extension remote from the body, said element in use, being heated by the passage of electric current to provide a heated surface in the combustion chamber to assist the ignition of fuel therein, an annular elongated member located about said extension, said member being formed from a material capable of withstanding the working conditions within the combustion chamber, at least a substantial portion of the inner surface of the member being disposed in spaced relationship to the surface of said extension, and an aperture in the wall of said elongated member, the end of the elongated member remote from the body defining an integral end closure, said aperture together with at least one further aperture being located in the elongated member adjacent the end closure.

* * * * *